United States Patent [19]

Chiquiar-Arias

[11] 4,358,028

[45] Nov. 9, 1982

[54] SINGLE DOSE DISPOSABLE CONTAINER

[75] Inventor: Marcelo Chiquiar-Arias, Mexico City, Mexico

[73] Assignee: Mercantile & Technical Promotions Inc., New York, N.Y.

[21] Appl. No.: 163,132

[22] Filed: Jun. 26, 1980

[51] Int. Cl.[3] ..... B65D 47/10

[52] U.S. Cl. ..... 222/107; 222/541

[58] Field of Search ..... 222/107, 541; 401/132; 128/260, 261, 232

[56] References Cited

U.S. PATENT DOCUMENTS

| | | | |
|---|---|---|---|
| 2,742,202 | 4/1956 | Dresden et al. | 222/541 |
| 2,761,598 | 9/1956 | Darlington, Jr. | 222/541 |
| 2,814,420 | 11/1957 | Elder, Jr. et al. | 222/541 X |
| 3,356,244 | 12/1967 | Witchell | 222/541 X |
| 4,248,227 | 2/1981 | Thomas | 128/261 |

*Primary Examiner*—Stanley H. Tollberg

*Attorney, Agent, or Firm*—Ladas & Parry

[57] ABSTRACT

An improved unit-dose disposable container of molded plastic preferably manufactured by injection molding in which the flexible body, rigid nozzle and breakable tip of the container are of successively narrower widths so as to maximize the number of mold cavities, which reduces manufacturing cost. The tip is designed so that it can be rotated between the thumb and forefinger by a relative movement between same transverse to the longitudinal axis of the container so as to minimize upsetting the contents of the container when the tip is broken off.

5 Claims, 5 Drawing Figures

FIG. 1
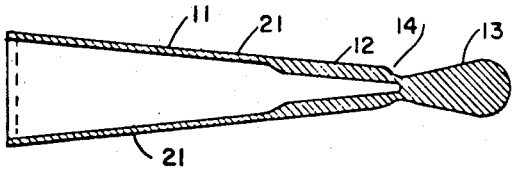
FIG. 1a
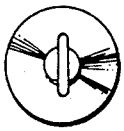
FIG. 2
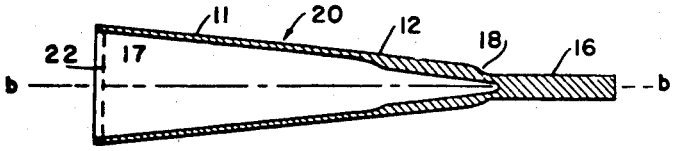
FIG. 2a
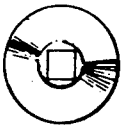
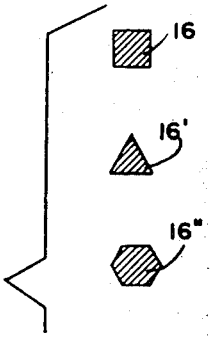
FIG. 3

SINGLE DOSE DISPOSABLE CONTAINER

BACKGROUND AND SUMMARY OF THE INVENTION

The present invention relates to improved single dose disposable containers for medical solutions and the like.

It has been of primary interest for a long time, and even more so lately, since hydrophylic or soft contact lenses were introduced, to deal with the hygienic and health problems associated with the storing of the medical solution in the currently used multi-dose containers.

The contamination of the medical solutions is due to their storage in the multi-dose containers for a given length of time, even though they have been bottled under sterile conditions, since sterility is lost once the container has been opened for dispensing the first dose.

In order to solve this problem, many medical solutions include preservatives which have a limited effectively and depend on the period of time the containers remain open; the medical solution eventually becomes contaminated. Due to the above, various types of unit-dose containers have been invented. My U.S. Pat. No. 3,777,949, granted Dec. 11, 1973, discloses in one embodiment a molded plastic container with a twist-off tab which opens up an orifice for dispensing the contents of the container.

The tab is twisted-off by rotating the hand of the user so as to snap the neck between the tab and the nozzle portion of the container. This twisting operation about the longitudinal axis of the container sometimes results in a jerking motion which can spill some of the contents of the container when the orifice at the end of the nozzle of the container is opened by the twisting off of the tab. Also this container, which is manufactured by an injection molding process, requiring divided female molds with opposing surfaces that open to allow the expulsion of the containers, since the tab portion has a greater width than the end of the nozzle adjacent the tab, thereby limiting the number of molding cavities that can be provided in the mold, to those of a single row.

Said U.S. Pat. No. 3,777,949, as well as U.S. Pat. No. 4,134,511, granted Jan. 16, 1979 show the use of cap openers to grasp the tip of such a container so as to avoid having the fingers of the user possibly contact the orifice after the twisting motion imparted by the cap opener to the tip results in the opening of the orifice between the tip and the nozzle. The cap opener shields the user's fingers, holding the cap opener, from the orifice, when formed. However, the cap opener is an additional item, which sometimes becomes lost. Furthermore, the cap opener in some instances, such as specifically taught in U.S. Pat. No. 4,134,511, could be used to close the container after the contents have been partially dispensed. For sanitary reasons it is desired that such a container be only for a single use and be constructed so as to prevent its partial use for subsequent dispensing. It is an object of the present invention to provide a single-dose, prophylactic container for dispensing medicinal solutions in which the container can be opened by a simple movement of the fingers while minimizing possible jolting of the container so as to prematurely discharge its contents. It is furthermore an object to provide such a container which can be preferably made by an injection molding process while maximizing the utilization of molding cavities in the mold. It is furthermore an object to provide a container in which the tip after being broken cannot be utilized to re-close the container.

In accordance with the present invention there is provided an improved unit-dose disposable container of molded plastic to be manually opened, without the need for accessories, for dispensing liquid medicines and the like, said container being molded as an integral piece so that its several parts disposed along a central longitudinal axis of the container are of sequentially narrower widths, said sequential parts consisting of:

a wide flexible body with a wall thickness adapted to be compressed for expelling the contents of the container;

a narrow, more rigid nozzle of greater wall thickness so as to be held with the thumb and finger on opening the container, and an even narrower, solid tip portion of substantially constant cross-section;

at least said wide flexible body and said nozzle portion defining therein a hollow cavity for receiving the liquid for dispensing from the container;

said tip portion being of sufficient length for holding with the thumb and finger and having sufficient cross-sectional area and having an outer gripping contour of a polygonal cross-section to form three or more graspable flat sides so that, while grasping the tip, a relative movement of the thumb and finger, similar to snapping the fingers, transverse to the longitudinal axis of the container is sufficient to break off said tip at a point adjacent the joining of the tip and the nozzle whereby to open the container and to permit expelling its contents through a resulting dispensing orifice communicating with the hollow cavity.

The tip portion of the present container has an outer gripping contour provided by a series of longitudinally extending ridges so that the tip can be rotated between the thumb and forefinger by moving the thumb and forefinger relative to each other along a path transverse to the longitudinally extending axis of the container. In this way the container can be grasped at the nozzle portion by the thumb and forefinger of one hand and the tip can be severed without rotating the entire hand grasping the tip as would be the case in the flat twisting tab shown in U.S. Pat. No. 3,777,949. In other words the tip is twirled without moving the wrist of the user, thereby minimizing possible jolting movements which might prematurely dispense the contents of the container after the orifice is opened by the torsional force applied to the tip by the twisting movement. The successively decreasing cross-sections of the wide flexible body, nozzle, and tip portion respectively, permit the containers to be molded with and expelled from standard one piece injection molds, which can and would have multiple rows of cavities that the mold size would allow, maximizing the number of possible cavities as determined by the diameter of the outer end of the wide flexible body portion as compared to the single row of cavities limitation of the mold that opens, necessary for manufacturing the container of U.S. Pat. No. 3,777,949. This characteristic of the invention considerably increases the container production output per injection, substantially reducing manufacturing costs which is of prime interest for disposable items, more so now because of the current world wide inflationary process, which is more acute in oil related items such as plastic containers, etc.

Furthermore, the broken off tip cannot be used to seal the resulting orifice since the outer dimensions of the tip portion are greater than the orifice diameter, which results from the breaking off between the nozzle portion, containing the hollow cavity, and the tip portion.

It is prefered that the cavity within the nozzle portion extends into the tip a short distance although it is possible for the inner cavity to terminate at the tip portion whereby an orifice will still result on breaking off the tip.

BRIEF DESCRIPTION OF THE DRAWINGS

FIG. 1 is a longitudinal cross-sectional view of a container according to the prior art;

FIG. 1*a* is an end view taken from the tip end of the container of FIG. 1;

FIG. 2 is a longitudinal cross-sectional view of a container according to the invention;

FIG. 2*a* is an end view, similar to that of FIG. 1*a*, taken from the tip end of the container of the invention;

FIG. 3 is a cross-sectional view of various possible tips for use in the container of the invention.

DESCRIPTION OF THE PREFERRED EMBODIMENT

Referring to the drawings, FIG. 1 shows a container according to U.S. Pat. No. 3,777,949 with a wide flexible body portion 11, a nozzle portion 12, for grasping by the fingers, and a tip portion 13 in the form of a flat tab, as shown by FIG. 1*a*. There is an indented break-off portion 14 to permit the severing of the tip portion 13 by twisting said flat tab.

In an embodiment according to the present invention, as shown in FIG. 2, the tip portion 16 has a square-cross-section and joins nozzle portion 12 with a substantially smaller indentation (18) corresponding to portion 14 of FIG. 1. The wide flexible body 11, nozzle 12, and tip portion 16 are of sequentially narrower widths and extend along the longitudinal axis b—b of the container 20 of the present invention. The hollow cavity 17 is contained within wide flexible body 11, nozzle 12 and a short distance into tip portion 16. An orifice will eventually be formed when the tip portion is broken off from the nozzle portion at region 18 where the tip portion 16 joins the nozzle 12.

The material of the container 20 is usually a plastic such as polythylene or polypropylene. A typical such container for ophthalmic solutions has a total length of two and one-half inches with the tip portion usually $\frac{1}{2}$ inch but at least $\frac{3}{8}$ inch long, the nozzle portion $\frac{5}{8}$ inch long with the tip having the cross-section of a square with each side of the square being 3/32 inch wide. The thickness of the container at flexible body portion 11 is suitable to be compressed for expelling the contents of the container, namely about 1/64 of an inch, and the thickness at the nozzle portion is greater, namely about 1/32 inch. The nozzle 12 is of sufficient thickness to be held with the thumb and finger while maintaining the container in a secure and steady condition during the breaking-off of the tab 16. The tab 16 has a polygonal cross-section to form three or more graspable flat sides so that, while gripping the tip, oppositely directed motion between the thumb and finger along a path transverse to the longitudinal axis of the container imparts a rotating movement to the tip about said longitudinal axis sufficient to break off said tip.

FIG. 3 shows various possible equilateral cross-sectional configurations for the tip 16, which in addition to the square configuration, is shown as triangular (16') and hexagonal (16'') round with ridges at four points (16''') and. The polygonal shapes (16, 16', 16'') are preferred because of the increased torsional rigidity provided. It is noted that configurations 16 and 16'' are radially symmetrical about the longitudinal axis of the container. The prior art container according to FIGS. 1 and 1*a* will have longitudinally extending, diametrically opposed ridge lines 21 resulting from where the mold surfaces of the opposing mold halves meet defining the outer configurations of the container. Whereas the container of the present invention would not have such lines.

If the inner cavity 17 does not extend to within tip portion 16, it must tangentially touch the plane passing through 18, where the tip 16 becomes severed from the nozzle 12.

The container is filled with the liquid at its open end which is then sealed inwardly to the dashed lines indicated at 22.

Although the drawings show only the preferred embodiment, the invention obviously can have different designs, for example the body and nozzle can be substantially parallel instead of tapered, etc., as long as the container widths are kept sequentially narrower.

I claim:

1. An improved unit-dose disposable container of molded plastic to be manually opened, without the need for accessories, for dispensing liquid medicines and the like, said container being molded as an integral piece so that its several parts disposed along a central longitudinal axis of the container are of sequentially narrower widths, said sequential parts consisting of:

a wide flexible body to be compressed for expelling the contents of the container;

a narrow, more rigid nozzle to be held with the thumb and finger on opening the container, and an even narrower, solid tip portion of substantially constant cross-section;

at least said wide flexible body and said nozzle portion defining therein a hollow cavity for receiving the liquid for dispensing from the container;

said tip portion being of sufficient length for holding with the thumb and finger and having sufficient cross-section area and having an outer gripping contour of a polygonal cross-section to form three or more graspable flat sides so that, while gripping the tip, oppositely directed motion between the thumb and finger along a path transverse to the longitudinal axis of the container imparts a rotating movement to the tip about said longitudinal axis sufficient to break off said tip at a point adjacent the joining of the tip and the nozzle whereby to open the container and to permit expelling its contents through a resulting dispensing orifice communicating with the hollow cavity, said rigid nozzle having sufficient wall thickness that when gripped the container is maintained in a secure and steady condition during the breaking-off of the tip portion.

2. A container according to claim 1, wherein the hollow cavity extends a short distance into the end of the tip portion adjacent the nozzle portion.

3. A container according to claim 1, wherein the tip portion has a square cross-section.

4. A container according to claim 1, wherein the tip portion has a triangular cross-section.

5. A container according to claim 1, wherein the outer contour of the tip portion is radially symmetrical about the longitudinal axis.

* * * * *